United States Patent [19]

Heuss

[11] Patent Number: 4,689,009

[45] Date of Patent: Aug. 25, 1987

[54] SKID SYSTEM FOR CARRYING A FURNACE CHARGE

[75] Inventor: Helmut Heuss, Ratingen, Fed. Rep. of Germany

[73] Assignee: Ruhrgas Aktiengesellschaft, Essen, Fed. Rep. of Germany

[21] Appl. No.: 800,304

[22] Filed: Nov. 21, 1985

[30] Foreign Application Priority Data

Nov. 24, 1984 [DE] Fed. Rep. of Germany ..... 3442880
Jul. 11, 1985 [DE] Fed. Rep. of Germany ..... 3524760

[51] Int. Cl.[4] ..... F27D 13/06
[52] U.S. Cl. ..... 432/234; 432/235
[58] Field of Search ..... 432/234, 233, 239, 121–127

[56] References Cited

U.S. PATENT DOCUMENTS

| | | | |
|---|---|---|---|
| 3,214,152 | 10/1965 | Molz | 432/235 |
| 3,367,641 | 2/1968 | Molz | 432/234 |
| 3,552,729 | 1/1971 | Hepp | 432/234 |
| 3,588,059 | 6/1971 | Weineck | 432/234 |
| 3,637,198 | 1/1972 | Knaak | 432/234 |
| 4,056,351 | 11/1977 | Knaak | 432/235 |
| 4,080,152 | 3/1978 | Altfeld et al. | 432/234 |
| 4,253,826 | 3/1981 | Campbell, Jr. | 432/234 |
| 4,391,587 | 7/1983 | Murakami et al. | 432/234 |

FOREIGN PATENT DOCUMENTS

| | | | |
|---|---|---|---|
| 2143214 | 3/1973 | Fed. Rep. of Germany | 432/234 |
| 44-29567 | 12/1969 | Japan | 432/234 |

*Primary Examiner*—Henry C. Yuen
*Attorney, Agent, or Firm*—Fay, Sharpe, Beall, Fagan, Minnich & McKee

[57] ABSTRACT

A skid system for carrying a charge in a pusher or walking-beam furnace incorporating a cooled skid pipe 3 and at least one rider 1 fitted on the skid pipe for carrying the charge in the furnace is, for permanent and effective insulation of the cooled skid pipe in the rider area designed for the rider 1 to comprise a charge-carrying support land and two channel-shaped leg portions 2 adjoining the land, the leg portions surrounding part of the periphery of the cooled skid pipe 3 in a spaced-apart relationship and for the space between the cooled skid pipe 3 and the inner surfaces of the leg portions 2 to form insulating spaces 4 filled with a thermal insulation material 4'.

21 Claims, 4 Drawing Figures

SKID SYSTEM FOR CARRYING A FURNACE CHARGE

BACKGROUND OF THE INVENTION

1. Field of the Invention

The present invention relates to a skid system for carrying a charge through a heat-treatment furnace said skid system comprising a cooled skid pipe and at least one rider fitted on said skid pipe for carrying said charge in said furnace. Such skid systems are mainly used in pusher furnaces and in walking-beam furnaces installed at rolling mills. Such riders are shapes for which castings resistant to high temperatures are preferably employed.

2. Prior Art

It is a common feature of all such known riders as described in the West German patent No. 22 31 223 that they do not provide for permanent thermal insulation between the rider and the skid pipe, the inadequate insulation being the cause of unnecessary heat loss and the transfer of relatively cold temperature from the cooled skid pipe across the rider to the charge.

SUMMARY OF THE INVENTION

It is an object of the present invention to provide for permanent and effective thermal insulation between the cooled skid pipe and the charge by an appropriate design of the rider of the skid system referred to hereinabove.

The present invention proposes the modification of known skid systems by providing for a rider comprising a charge-carrying land and adjoining channel-shaped leg portions having inner surfaces surrounding part of the periphery of cooled skid pipe in a spaced-apart relationship, the outer surface of said cooled skid pipe and the inner surfaces of said leg portions thereby forming insulating spaces. Said insulating spaces which are preferably filled with a thermal insulation material such as a ceramic fiber shape resistant to high temperature are covered by said channel-shaped leg portions and thereby protected against the ingress of liquid slag. If the thermal resistivity of said thermal insulation material in said insulating spaces between said cooled skid pipe and said channel-shaped rider leg portions is selected properly, the surface temperature of said channel-shaped leg portions becomes the same as the charge temperature thereby avoiding undesirable heat transfer from the charge to the cooled skid pipe. The heat insulating material received by said insulating spaces is practically protected from all sides, secured against falling out of said insulating space and designed for effective thermal insulation due to its arrangement between the cooled skid pipes and the rider leg portions having inner surfaces surrounding part of the periphery of said skid pipe in a spaced-apart relationship.

According to the present invention heat transfer across unavoidable thermal bonds between the charge-carrying land of said rider and the adjoining rider leg portions may be minimized by the provision of longitudinal recesses in the transitions between said rider leg portions and said land and by filling a high temperature resistant ceramic casting mass of relatively low thermal conductivity into said recesses.

The rider according to the present invention comprising a land and channel-shaped leg portions is preferably one casting.

Heat transfer from the carrying surface of the rider land to the cooled skid pipe minimizing heat loss by radiation may be optimized according to the present invention by providing for a center rider land fitted with webs protruding upward and downward from the joints between said symmetrical leg portions, said symmetric rider design minimizing any thermal stress.

One embodiment of the present invention provides for recesses in the inner surfaces of the channel-shaped leg portions to receive holding devices fitted to the cooled skid pipe, thereby integrating said holding devices restraining the rider in the longitudinal direction in the thermal insulation provided for. by the present invention, the channel-shaped leg portions of the rider covering said holding devices, thereby avoiding the creation of thermal bonds between the cooled skid pipe and the rider leg portions.

According to a further embodiment of the present invention making mainly provisions for a skid system comprising a skid pipe of a circular cross section, at least one T-bar is fitted to the top of said skid pipe, the web of said T-bar pointing upward and extending parallel to a centerline of said skid pipe and the rider being provided with a bottom groove substantially complementary with said T-bar web and a stay limiting said groove, thereby allowing said rider to be placed on said T-bar on said skid pipe. The embodiment of the present invention described in the preceding sentence also allows satisfactory heat transfer from the charge-carrying surface of the rider land across said T-bar to the cooled skid pipe to which said T-bar is generally fitted by welding. In a preferred embodiment, pairs of such T-bars of the same cross section are aligned in one vertical plane at a certain distance and firmly connected with the skid pipe, the stay of the rider engaging, with a certain clearance, in the empty space between two such T-bars, said stay limiting two grooves fit for receiving the webs of said two T-bars. The webs of said T-bars engaging in said rider grooves provided with said stay are in contact with said stay thereby transferring all horizontal forces acting on the rider during charge travel to the skid pipe.

BRIEF DESCRIPTION OF THE DRAWINGS

The skid system according to the present invention will now be described with the help of preferred embodiments illustrated in the accompanying drawings.

DETAILED DESCRIPTION OF THE INVENTION

Figure 1:
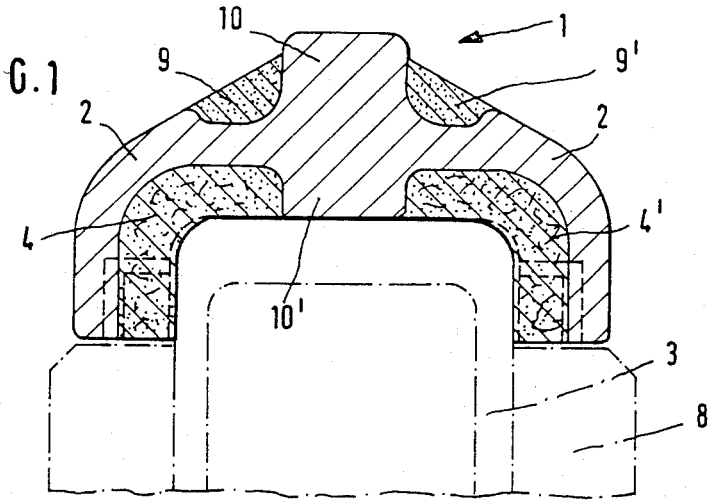
FIG. 1 shows a cross section of an embodiment of the present invention in the direction of arrows I—I shown in FIG. 2.
Figure 2:
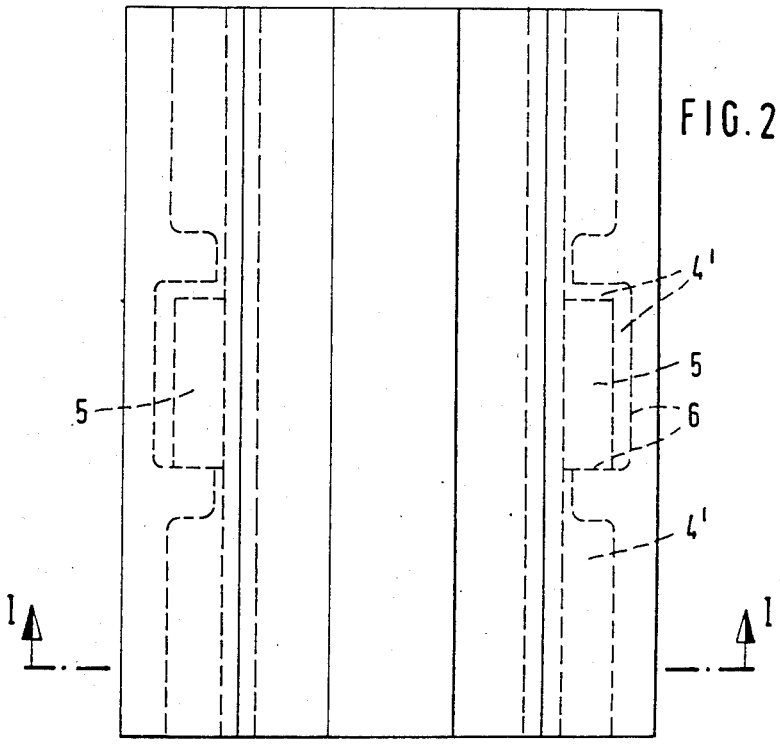
FIG. 2 shows a top view of the rider embodiment shown by FIG. 1.

Referring first to FIG. 1, the rider 1, symmetric relative to a vertical plane extending in the longitudinal direction, comprises a land 10 carrying the charge and two channel-shaped leg portions 2 adjoining said land 10 at opposite sides thereof approximately in the center of said land. The rib 10' protruding downward from the joints between said land 10 and the two channel-shaped leg portions 2 is placed on a skid pipe 3. Said two leg portions 2 surround in a spaced-apart relationship the upper part of the periphery of said cooled skid pipe 3 and extend downward ending close to the insulation 8 of said skid pipe 3. The inner surfaces of said two leg portions 2, the rib 10' of said land 10 and the adjacent part of the periphery of said skid pipe 3 enclose an insulating space 4 receiving a ceramic fibre shape 4'. As FIG. 2 shows, holders 5 welded to the sides of the skid pipe 3 engage in recesses 6 of the leg portions 2 of rider 1, the spaces between said holders 5 and the recessed sides 2 also being filled with ceramic fibre material to prevent any thermal bonds between said skid pipe 3 and said leg portions 2 and thereby the furnace chamber.

As shown in FIG. 1 the outer transitions between the charge-carrying land 10 and the leg portions 2 are provided with longitudinal recesses 9 filled with appropriate ceramic casting mass 9'.

The insulation material 4' protected by the channel-shaped leg portions 2 minimizes heat transfer between the outer surfaces of said two channel-shaped leg portions 2 and the cooled skid pipe 3 above the skid pipe insulation 8.

Figure 3:
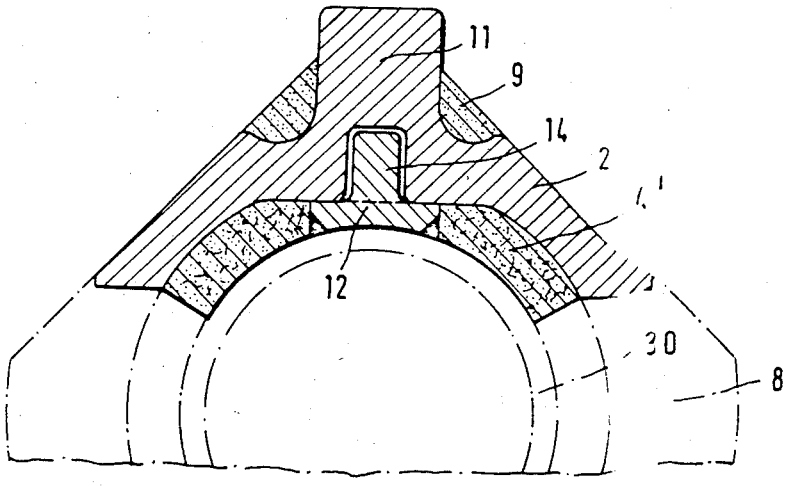
FIG. 3 shows a cross section of another embodiment of the skid system according to the present invention associated with a skid pipe of circular cross section, the view being similar to the view of FIG. 1.
Figure 4:
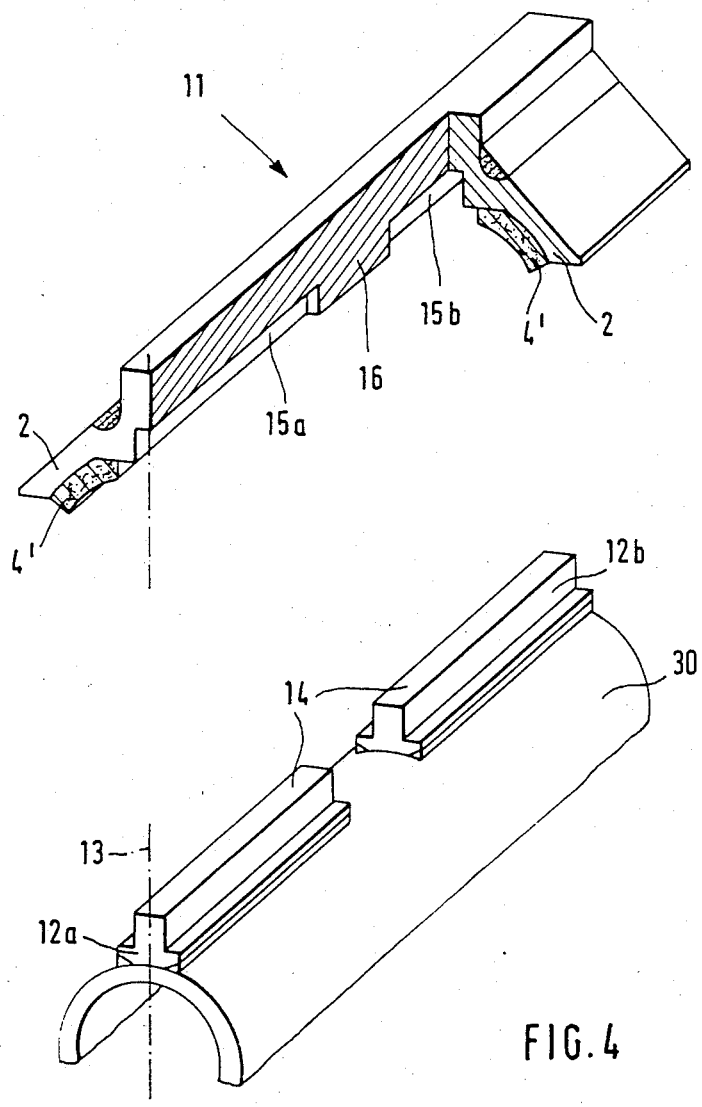
FIG. 4 shows a partially sectional exploded view of the embodiment of present invention shown by FIG. 3.

FIGS. 3 and 4 show an embodiment of the present invention preferred mainly for a configuration wherein the cooled skid pipe 30 is of circular cross section. Unlike the rider described by reference to FIGS. 1 and 2, the rider 11 is not directly in contact with the skid pipe by a web protruding from the rider but indirectly by means of T-bars rib or holder 12 (preferably two T-bars **12*a* and 12*b* as shown in FIG. 4) fitted on the skid pipe 30. Said two T-bars are aligned in one vertical plane 13 intersecting with the centerline of skid pipe 30 and welded to the top of said skid pipe. The webs 14 of said T-bars 12*a* and 12*b*** point upward while the flanges of said T-bars are arranged in a horizontal plane.

In the embodiment of the present invention shown by FIGS. 3 and 4 the rider 11 is provided with grooves **15*a* and 15*b* substantially complementary with the webs 14 of said T-bars 12*a* and 12*b*, said grooves being limited by stay 16 as shown in FIG. 4. The width of said stay 16 is chosen as necessary for rider 11 to engage, with a certain clearance, in the empty space between the webs 14 of T-bars 12*a* and 12*b*, the rider 11 placed on skid pipe 30 over T-bars 12*a* and 12*b* thereby being locked in position by the groove walls and stay 16 for horizontal forces in any direction to be transferred from said rider 11 to said skid pipe 30**.

The length of said T-bars **12*a* and 12*b* and the position of stay 16, limiting at least one groove, or recess 15*a* or 15*b* relative to rider 11 are uncritical parameters and stay 16 may be provided at the end of rider 11 limiting only one groove 15**.

As FIG. 3 shows best, the flange of the T-bar supports the rider as the web protruding from the rider 1 shown in FIG. 1. The near-groove parts of rider 11 supported by said T-bar flange are in one horizontal plane and the surface portion of said near-groove rider further extends laterally and merges into said inner surfaces of the leg portions 2 of said rider 11 thereby defining the insulating space 4 in the case of the embodiment of the present invention shown by FIGS. 3 and 4 as in the case of the embodiment shown by FIGS. 1 and 2, said inner surfaces of said leg portions 2 being bent towards the outside to match the shape of the skid pipe 30 or the thermal insulation material 4' in insulating space 4.

The thermal insulation material 4' in the insulating space 4 is preferably selected as a function of the maximum surface temperature of the material used for rider 11. If said maximum surface temperature is substantially the same for the entire furnace, a material with relatively high thermal resistivity such as ceramic fibre is preferably selected for a comparatively cold part of the furnace in which the skid system according to the present invention is used while a material of lower thermal resistivity such as a light-weight ceramic mass or a heavy refractory mass or burnt ceramic parts are used for thermal insulation in a comparatively hot part of said furnace.

I claim:

1. A skid system for carrying a charge travelling through a heat-treatment furnace, and more particularly a pusher furnace or a walking-beam furnace, said skid system comprising:

a cooled skid pipe, at least one metal rider fitted on said skid pipe for supporting said charge in said furnace;

said rider comprises an integral one piece casting having a charge-carrying land and channel-shaped leg portions adjoining said land at opposite sides thereof, said leg portions having inner surfaces surrounding part of the periphery of said cooled skid pipe in a spaced-apart relationship;

a heat conducting support means below said land, extending along and between said skid pipe and said rider, said support means providing a direct heat conducting path between said skid pipe and said rider;

opposite sides of said support means, said inner surfaces of said leg portions and the adjacent periphery of said skid pipe defining insulating spaces on opposite sides of said support means; and thermal insulating material substantially filling said spaces between said cooled skid pipe and said inner surfaces.

2. A skid system according to claim 1, said thermal insulation material being selected from the group consisting of a high thermal resistance ceramic fibre material, a light-weight ceramic mass, a heavy refractory mass and a burnt ceramic material.

3. A skid system according to claim 1, wherein a longitudinal recess is provided in each of the transition areas between said leg portions and said charge-carrying land, said recesses being filled with a ceramic casting mass.

4. A skid system according to claim 1 wherein said rider has a vertical center plane of symmetry, and said land is arranged in said central plane and is provided with stiffening ribs protruding both to the top and to the bottom from the joints between said symmetrical leg portions and central land, said bottom rib engages said skid pipe and constitute said support means to fully support said rider on said skid pipe.

5. A skid system according to claim 4 wherein an outwardly and upwardly opening longitudinal recess is provided in each of the transistion areas between said leg portions and said charge-carrying land means, and further including an insulating ceramic casting mass filling said recesser.

6. A skid system according to claim 5, wherein said rider is symmetrical with respect to a vertical center plane and is provided with a stiffening rib protruding upward from the joints between said leg portions and land means.

7. A skid system according to claim 6, further including at least one holder fixed to the outer surface of skid pipe, and extending parallel to a centerline of said skid pipe; and said rider means provided with at least one recess opening radially inward with and receiving said holder for preventing horizontal movement between said skid pipe and said rider.

8. A skid system according to claim 4, further including at least one holder fixed to the outer surface of skid pipe, and extending parallel to a centerline of said skid pipe; and said rider means provided with at least one recess opening radially inward substantially complementary with and receiving said holder for preventing horizontal movement between said skid pipe and said rider.

9. A skid system according to claim 1, wherein the inner surfaces of said channel-shaped leg portions are provided with recesses for receiving holding devices fitted to said skid pipe.

10. A skid system according to claim 1, wherein said support means includes at least one T-bar is fitted to the top side of said skid pipe, the web of said T-bar pointing vertically upwards and extending parallel to a centerline of said skid pipe and wherein said rider is provided with at least one groove opening vertically downwards substantially complementary with said web of said T-bar and wherein said rider is provided with a stay limiting said groove and wherein said rider may be placed on said skid pipe over said T-bar.

11. A skid system according to claim 10, wherein pairs of T-bars of the same cross section are aligned in one vertical plane at certain distances and firmly connected with said skid pipe and wherein said stay of said rider engages, with a certain clearance, in the empty space between two such T-bars, said stay limiting two grooves fit for receiving the webs of said two T-bars.

12. A skid system according to claim 10, wherein said rider is supported by the flanges of at least one such T-bar.

13. A skid pipe according to claim 12, wherein the surface portion of said rider supported by said T-bar flanges further extends laterally and merges into said inner surfaces of said leg portions thereby defining said insulating space.

14. A skid system according to claim 13, wherein said inner surfaces of said leg portions each have a first section adjacent to said T-bar and said first sections are disposed in a common horizontal plane and wherein said skid pipe has a substantially circular cross section and wherein each such leg portion has a second section extending from said first section and bent around said substantially circular cross section of said skid pipe further downwards.

15. A skid system according to claim 1, wherein said rider is symmetrical with respect to a vertical center plane and is provided with a stiffening rib protruding upward from the joints between said leg portions and land means.

16. A skid system according to claim 1, wherein said support means is a part of the integral casting with said rider.

17. A skid system according to claim 16, wherein an outwardly and upwardly opening longitudinal recess is provided in each of the transition areas between said leg portions and said charge-carrying land means and further including an insulating ceramic casting means filling said recessor.

18. A skid system according to claim 17, further including at least one holder fixed to the outer surface of skid pipe, and extending parallel to a centerline of said skid pipe; and said rider means provided with at least one recess opening radially inward substantially complementary with and receiving said holder for preventing horizontal movement between said skid pipe and said rider.

19. A skid system according to claim 1 wherein said support means is separate from said rider and fixedly secured to said skid pipe, said rib means being generally of inverted T-shape having a central upstanding web and horizontal flanges, the upward surface of said flanges engaging said rider, and said rider having a downwardly opening recess receiving therein said web for preventing relative horizontal movement between said rider and said skid pipe.

20. A skid system according to claim 19, wherein an outwardly and upwardly opening longitudinal recess is provided in each of the transition areas between said leg portions and said charge-carrying land means, and further including an insulating ceramic casting means filling said recesser.

21. A skid system according to claim 1, wherein said rider is symmetrical with respect to a vertical central plane and is provided with a supporting and stiffening rib extending integrally downward from its central portion to constitue said support means.

* * * * *